US007188880B1

(12) United States Patent
Frieder et al.

(10) Patent No.: US 7,188,880 B1
(45) Date of Patent: Mar. 13, 2007

(54) RAPID MEDICAL EVACUATION SYSTEM FOR TRAUMA PATIENTS

(75) Inventors: Russell Frieder, Santa Barbara, CA (US); Srirangam Kumaresan, Goleta, CA (US); Anthony Sances, Jr., Santa Barbara, CA (US); Will. J. Myers, Rogers, AR (US); L. William Harvey, Fayetteville, AR (US)

(73) Assignee: Calzark, LLC, Goleta, CA (US)

( * ) Notice: Subject to any disclaimer, the term of this patent is extended or adjusted under 35 U.S.C. 154(b) by 0 days.

(21) Appl. No.: 11/243,072

(22) Filed: Oct. 3, 2005

(51) Int. Cl.
*A61G 1/02* (2006.01)

(52) U.S. Cl. ..... 296/20; 296/19

(58) Field of Classification Search ..... 296/20, 296/19
See application file for complete search history.

(56) References Cited

U.S. PATENT DOCUMENTS 2,398,730 A * 4/1946 Terry ..... 296/19
4,097,941 A * 7/1978 Merkel ..... 295/20
4,115,884 A * 9/1978 Keogh ..... 296/19
D269,077 S * 5/1983 Horton ..... D12/1
D269,078 S * 5/1983 Taylor ..... D12/1
5,573,300 A * 11/1996 Simmons ..... 296/19
5,632,521 A * 5/1997 Archambault et al. ... 296/65.13
5,702,142 A * 12/1997 Newell ..... 296/19
6,175,977 B1 * 1/2001 Schumacher et al. ..... 5/626
6,332,638 B1 * 12/2001 Menna ..... 296/20

* cited by examiner

*Primary Examiner*—Kiran B. Patel
(74) *Attorney, Agent, or Firm*—Michael G. Petit

(57) ABSTRACT

A system comprising an assembly of structures and supports operable for installation in a vehicle for the purpose of transporting at least one medical attendant, one patient disposed on a stretcher, and a driver on a small utility vehicle having a flat horizontal surface or "bed". The invention provides an improved method for evacuating injured people such as, for example, injured victims of a terrorist attack, or injured soldiers from a battlefield, on a relatively narrow vehicle. The supports are arranged so that at least one patient on a stretcher or spineboard can be placed longitudinally in the bed of the vehicle with a medical practitioner positioned adjacent the patient to attend to the patient's medical needs during transport.

4 Claims, 10 Drawing Sheets

RAPID MEDICAL EVACUATION SYSTEM FOR TRAUMA PATIENTS

BACKGROUND OF THE INVENTION

1. Field of the Invention

The present invention relates to a system for attachment to a vehicle for the transport of injured people.

2. Prior Art

Mass casualty events, such as wartime battles, natural disasters, and terrorist attacks, often require immediate medical care for large numbers of victims. Emergency treatment of the victims is usually initiated either near the site where the injuries occur or while the victim is in transit to a permanent medical facility. The quality of care, as well as the number of patients that can be cared for, depends greatly on the capability of the vehicles and personnel tasked with responding to the emergency. Ideally, such vehicles would be capable of carrying multiple patients, provide sufficient room for an attendant to initiate medical care while the patient(s) are in transit, and be adaptable to suit a variety of emergency situations.

One such emergency situation is that of a terrorist attack, or other mass casualty incident, taking place in a densely populated urban environment. Following such an event, traffic jams and pedestrian congestion can make small city streets impassible to standard size ambulances. Additionally, fallen debris can create off-road like conditions on top of normally smooth paved surfaces. Such conditions call for the use of small off-road utility vehicles that are more maneuverable than full size ambulances. These vehicles are generally short and narrow in order to increase maneuverability in tight quarters and over uneven terrain. They are often light pickup trucks, golf carts, parking enforcement vehicles or other similarly sized platforms. Once these vehicles reach the injured, their narrow width restricts both the number of patients that can be transported as well as the onboard working space provided to the medical attendant.

Prior art stretcher mount systems are known that allow for the transport of multiple patients, but they make use of cantilevered platforms attached to the side or rear of a vehicle. Such systems reduce a vehicle's mobility by increasing its effective width, and by negatively impacting weight distribution. Alternatively, there exist multi-patient transport systems that remain within the vehicle's normal envelope or "footprint", but in doing so eliminate the space necessary for an attendant to provide adequate medical care while a patient is in transit.

It would be beneficial to the victims of such an incident if there were a stretcher support system that could be attached to these small utility vehicles that allowed for the simultaneous evacuation and medical treatment of multiple patients, without negatively affecting vehicle maneuverability. While vehicle dimensions may prevent a support system from totally achieving this goal, it is possible to have a system for transporting multiple patients that can be rapidly configured for either optimal onboard working space or maximum vehicle maneuverability. If such a system existed, small utility vehicles could travel down narrow city streets more easily than either full size ambulances or utility vehicles with outboard racks. Once on the scene, the support system could be quickly reconfigured for optimal en route medical care. Multiple patients could then be loaded and provided with medical treatment while being evacuated from the site of injury.

An additional emergency situation in which medical personnel would be aided by the provision of a light vehicle with an adaptable stretcher mounting system is that of an attack involving the use of chemical, biological, radiological, or nuclear weapons. In such an event, emergency service coordinators generally construct an artificial zone around the site of the attack that is considered contaminated. Emergency workers are then tasked with entering this "hot" zone and extracting injured and contaminated victims. While in the hot zone, these workers generally wear protective suits to shield themselves from the harmful agent(s).

Though some victims are simply dragged out by hand, there is an increasing dependency on small utility vehicles to transport those who are injured and/or contaminated away from the site of the attack. Emergency personnel wearing bulky protective clothing have a difficult time providing adequate medical care in the limited space offered by the stretcher mount systems currently used aboard narrow utility vehicles. It would be highly beneficial to the victims of this type of attack if there were a system that could be attached to small emergency vehicles that allowed multiple patients to be transported away from the contaminated area while receiving care from a medical attendant wearing a protective suit. It would be additionally advantageous if the stretcher mounting system could be collapsed to either exploit the base vehicle's full maneuverability or simply to minimize the size of the vehicle for storage purposes.

U.S. Pat. No. 5,702,142 discloses a set of structures and supports intended to allow two medical attendants, one patient on a spineboard, one ambulatory patient, and a driver to travel aboard a small utility vehicle. The invention provides an improved method of evacuating injured athletes off of a playing field. The supports are arranged so that one patient on a stretcher or spineboard can be placed longitudinally along the passenger side of the vehicle. An attendant is then located near the front passenger seat of the vehicle, but turned to face rearward. An additional attendant is placed behind the driver seat, facing sideways, towards the passenger side of the vehicle. An ambulatory patient is then placed at the rear driver's side of the vehicle, facing rearwards. This system is limited in that it only allows for the transport of one patient on a stretcher. This invention is not ideal in the case of a mass casualty event primarily because it was intended to be used in situations where there are very few injuries and relatively large numbers of medical personnel. This results in space aboard the vehicle that could be used for an additional patient, instead being occupied by a second attendant seat. An additional disadvantage of the system is that it requires the use of multiple straps to restrain the patient and stretcher on the vehicle. In an event where there are many severely injured people, it is important that the stretchers be loaded as quickly as possible. The time required to attach and tighten the straps may be detrimental to the survival of the injured parties. Vehicles responding to mass casualty situations would be better suited by a system that maximized the number of critically injured that could be transported.

SUMMARY

The present invention is directed to a medical evacuation assembly adapted for installation in a vehicle that substantially obviates one or more of the limitations of the related art. To achieve these and other advantages and in accordance with the purpose of the invention, as embodied and broadly described herein, the invention includes a a support assembly adapted to be installed in a vehicle having an open flat bed bounded laterally by left and right sides extending upwardly from the flat bed. The flat bed is open at the rear thereof. The support assembly is operable for receiving a stretcher bearing a patient. Two support assemblies that are mirror images of each other are preferably mounted side by side in the flat bed of a vehicle. Each support assembly includes lateral extension means operable for moving a stretcher attached thereto in a lateral direction with respect to a midline of the open flat bed thereby providing space for an attendant between the stretchers.

More particularly, the present inventors disclose a support assembly adapted to be installed in a vehicle. The vehicle has an open flat bed bounded laterally by left and right sides extending upwardly from the flat bed, the bed being open at the rear thereof. Each support assembly is operable for receiving a stretcher bearing a patient. The stretcher has two equally spaced legs at forward and rearward ends thereof. In a preferred embodiment, each support assembly comprises a plurality of base rails, preferably three, comprising rigid elongate members having a medial end and a lateral end. An upper mount is affixed to the lateral end of each base rail. The upper mount is operable for affixing the lateral end of each base rail to the uppermost portion of a side of the flat bed of the vehicle. An upper end of a support strut is pivotally mounted to the medial end of each base plate. A support strut mounting plate is pivotally attached to a lower end of each support strut. The support strut mounting plate is operable for attaching the lower end of the support strut to the flat bed of the vehicle. The support struts collectively serve to support the base plates above, and parallel to the plane of the flat bed. The support assembly further includes a plurality of rigid elongate slide rails having a medial end and a lateral end, each slide rail being slidably attached to one of the base rails such that the slide rail is movable in a direction parallel to the length of the base rail. A slide rail locking means is affixed to each base rail. The slide rail locking means is operable for locking the slide rail in a predetermined position (i.e., extended or retracted) with respect to the base rail. First and second guide rails comprising rigid elongate members having a "C-shaped" cross section are affixed to the slise rails. The first guide rail is affixed to the medial end of the slide rails, and said second guide rail is affixed to the lateral ends of the slide rails such that they are parallel to one another and extend in a forward-rearward position in the flat bed of the vehicle. The "C" shaped groove in the upper surface of the guide rails is operable for slidably receiving the legs of the stretcher. Stretcher locking means are disposed on the guide rails. The stretcher locking means is operable for maintaining the legs of the stretcher in locking engagement with the guide rails. The support assembly further includes at least one lock release means operable for unlocking the stretcher locking means to disengage the legs of the stretcher from the guide rail for removing the stretcher from the support assembly.

In practice, two support assemblies, each being a mirror image of the other, are installed in the flat bed of a vehicle by affixing the lower ends of the struts to the flat bed of the vehicle and the lateral ends of the slide rails to the sides of the flat bed by respective attachment means. The front legs of a stretcher bearing a patient are placed into the groove in the rearward end of the guide rails and slid forward until the front legs of the stretcher lockingly engage the leg locking mechanism attached to the guide rail. Once the stretcher lockingly engages the guide rails, the lateral positioin of the stretcher is adjusted by moving the stretcher laterally. When the desired position of the stretcher with respect to the midline of the flat bed is achieved, the slide rail, which supports the guide rails, is locked to the base rail to prevent lateral translation of the stretcher. When both support assemblies are extended away from the midline of the flat bed, an attendant can occupy the space between the two stretchers to provide assistance to the patients as needed.

The features of the invention believed to be novel are set forth with particularity in the appended claims. However the invention itself, both as to organization and method of operation, together with further objects and advantages thereof may be best understood by reference to the following description taken in conjunction with the accompanying drawings.

PARTS LIST

Figure 1:
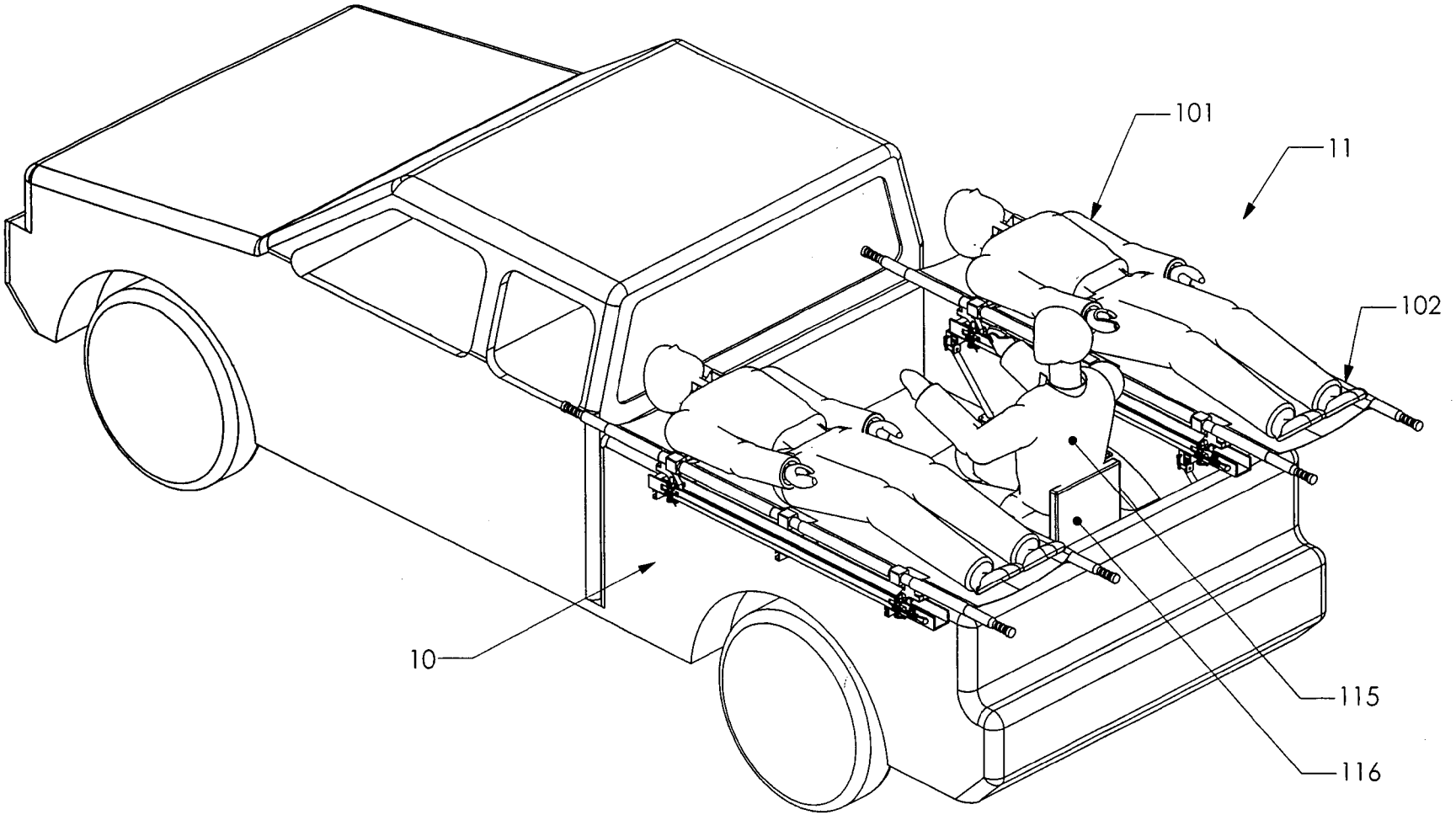
FIG. 1 is a perspective view of the Rapid Medical Evacuation System for Trauma Patients (RMES), with both support assemblies in the extended position, as it would be installed on a small pickup truck.

| | Part Name | Part Description |
|---|---|---|
| 10 | Support Assembly, Left | Supports and restrains stretcher on left side of vehicle. Can be set in either an "extended" or "centered position". |
| 11 | Support Assembly, Right | Supports and restrains stretcher on right side of vehicle. Can be set in either an "extended" or "centered" position. |
| 81 | Front leg, Stretcher | |
| 101 | Patient | |
| 102 | Stretcher | |
| 103 | Guide Channel | Longitudinally oriented channel into which the legs of the stretcher are slid. C shaped cross section prevents stretcher from moving side to side. Provides mounting surface for stretcher locks. |
| 104 | Spring Mechanism | Spring loaded mechanism that controls the motion of the Stretcher Lock Lever. Provides constant force that pushes the Lock Lever into the locked position. Prevents Lock Lever from disengaging unless the system is manually |

-continued

PARTS LIST

| | Part Name | Part Description |
|---|---|---|
| | | disengaged using the Release Lever. |
| 105 | Cable, Lock Release | Cable that connects the front and rear Lock Levers on either the right or left side of the Support Assembly. Releases front Lock Lever when rear Lock Lever is disengaged. Allows both the front and rear locks on one side of the Support Assembly to be disengaged simultaneously. |
| 106 | Slide Rail | Transversely oriented rail that connects and supports the two guide channels. Inner side of Slide Rail provides a guide way for rolling or sliding mechanism. Facilitates lateral adjustment of the upper parts of the Support Assembly position. |
| 107 | Release Clamp, Lock | Used to manually disengage both Lock Levers on either the right or left side of the vehicle. |
| 108 | Mount, Support Strut | Mount pad used to attach the Support Strut to the vehicle. The mount can be used with bolts, tie-downs, latches, or other fastening means to permanently or temporarily attach the support strut to the cargo bed. |
| 109 | Strut, Support | Provides vertical support for the inner ends of the Base Rails |
| 110 | Lock Lever | Lever that locks one corner of the stretcher onto the Support Assembly by rotating into the open area in the stretcher leg. The Lever automatically engages the stretcher leg as the Stretcher is loaded on to the Support Assembly, and is manually disengaged by the Lock Release Lever. One Lock Lever is employed at each of the four stretcher legs. |
| 111 | Mount, Upper | Mount pad used to attach the outer ends of the Base Rails to the vehicle. The mount can be used with bolts, tie-downs, latches, or other fastening means to permanently or temporarily attach the mount rails to the sides of the cargo bed. |
| 112 | Base Rail | Transversely oriented rail that is rigidly mounted to the vehicle through the Upper Mount and the Support Strut. Supports the weight of the Patient, Stretcher, Guide Channels, Slide rails, locks, etc. Includes Sliding or rolling mechanism that facilitates lateral adjustment of the upper parts of the Support Assembly. Contains the Slide Rail Position Locks. |
| 113 | Lock, Slide Rail Position | Mechanism that locks the upper parts of the Support Assembly in place. Prevents accidental lateral motion of the Slide Rails, once the Support Assembly has been set in either the centered or extended position. |
| 114 | Stop | Fixed crossmember that prevents the forward leg of the stretcher from sliding off the front of the Guide Channel |
| 115 | Attendant | |
| 116 | Seat, Attendant | Collapsible seat for attendant. |

DESCRIPTION OF THE PREFERRED EMBODIMENTS

The Rapid Medical Evacuation System for Trauma Patients (RMES) in accordance with the present invention is intended to be installed in small utility vehicles that, in general, have side by side seating for a driver and passenger in front, and have a cargo bed in the rear. While the RMES is applicable to any vehicle having a rear cargo bed, its benefits are most pronounced when attached to vehicles with narrow widths. Such vehicles include small pickup trucks, off-road utility vehicles, golf karts, etc that have overall "footprint" widths between 50 and 70 inches.

Figure 6:
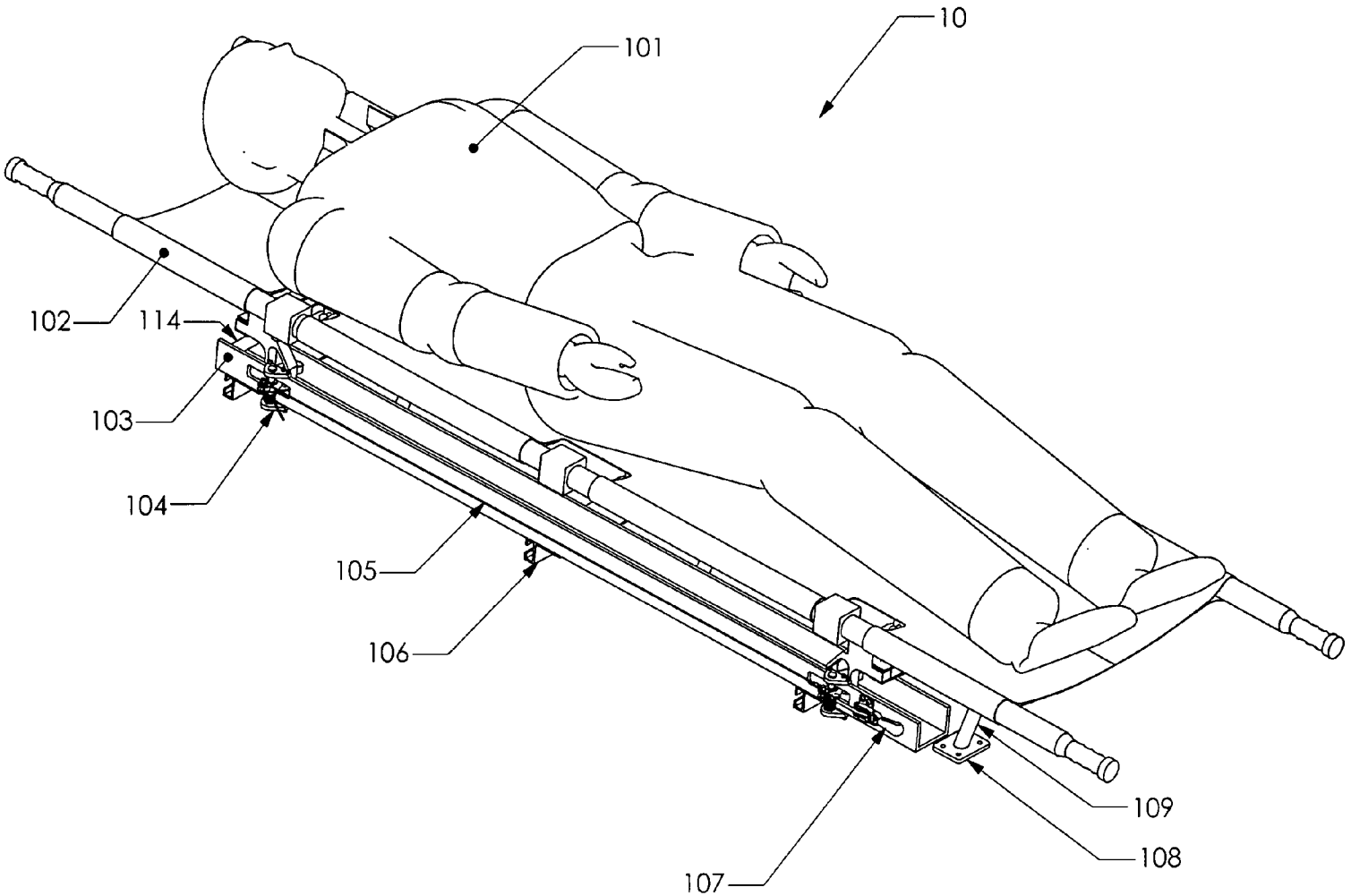
FIG. 6 is a perspective view of a patient on a stretcher loaded onto the left support assembly that has been configured in the extended position.
Figure 7:
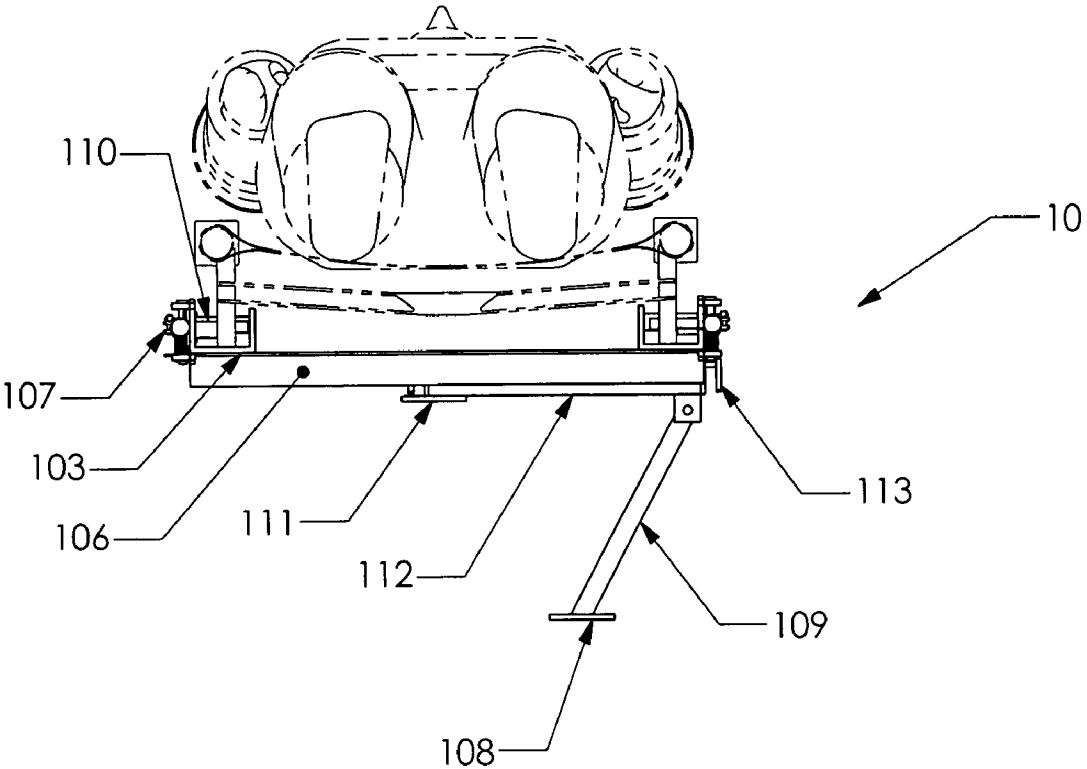
FIG. 7 is a rear view of a patient on a stretcher loaded onto the left support assembly that has been configured in the extended position.
Figure 8:
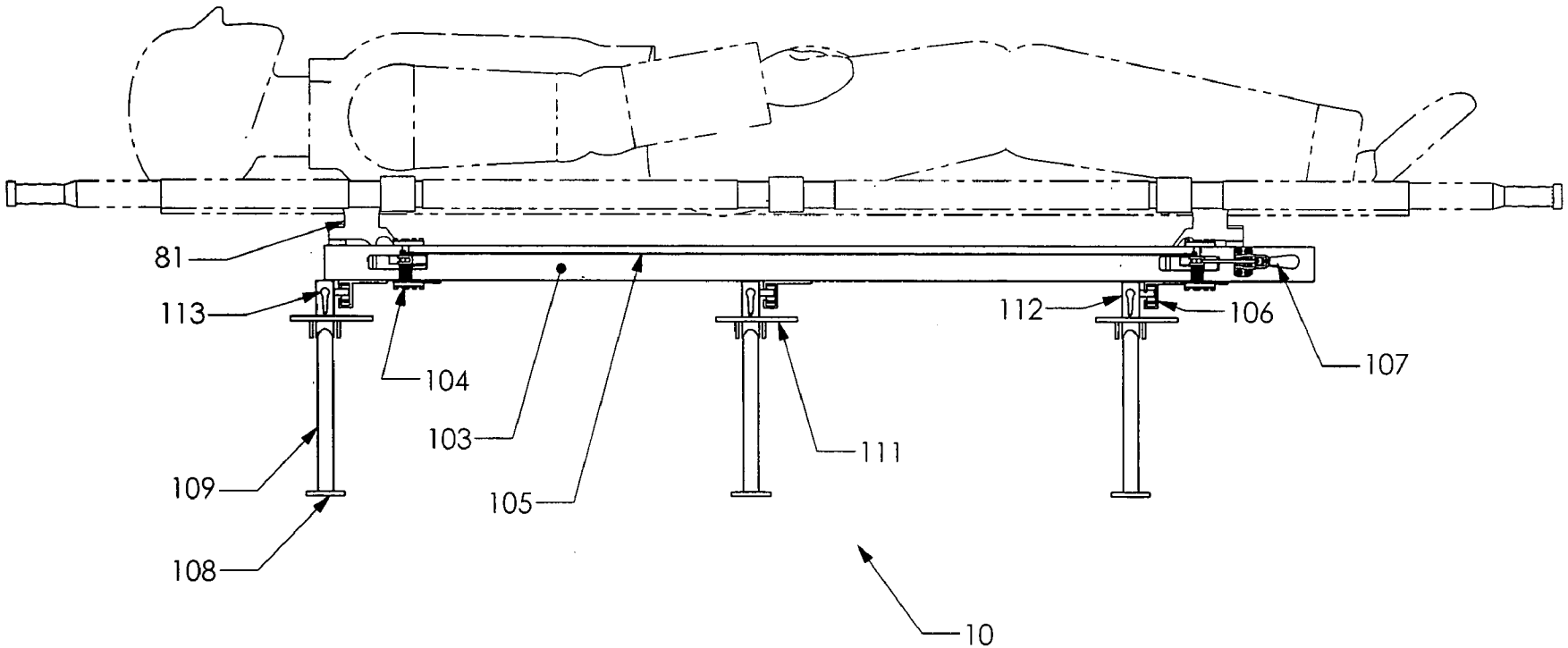
FIG. 8 is a side view of a patient on a stretcher loaded onto the left support assembly that has been configured in the extended position.

With alternate reference now to FIGS. 1 and 6, the RMES system is installed in the rear cargo bed of a vehicle and comprises a left support assembly 10, a right support assembly 11, and a collapsible attendant seat 1116. Each of the support assemblies 10 and 11 is equipped with a retention system 104, 110 (FIG. 9) that automatically engages and restrains a stretcher as it is being loaded. While the system described below is specifically intended to accept NATO style stretchers, certain adjustments could be made to the retention system 104, 110 and guide channels 103 (FIG. 6) to facilitate other types of stretchers.

The RMES system is novel in that each of the support assemblies 10 and 11 can be laterally fixed in either a "centered" position (FIG. 2) or an "extended" position (FIG. 1). When located in the centered position (FIG. 2), the support assemblies 10 and/or 11 and affixed stretcher(s) will not extend laterally past the widest point of the vehicle's footprint. When located in the extended position (FIG. 1), the support assembly 10 and/or 11 and affixed stretcher will extend laterally beyond the side of the vehicle by approximately one half the width of the stretcher. The attendant seat 116 is located in the center of the vehicle cargo bed and, when collapsed, is lower than the undersides of the support assemblies 10 and 11.

Figure 2:
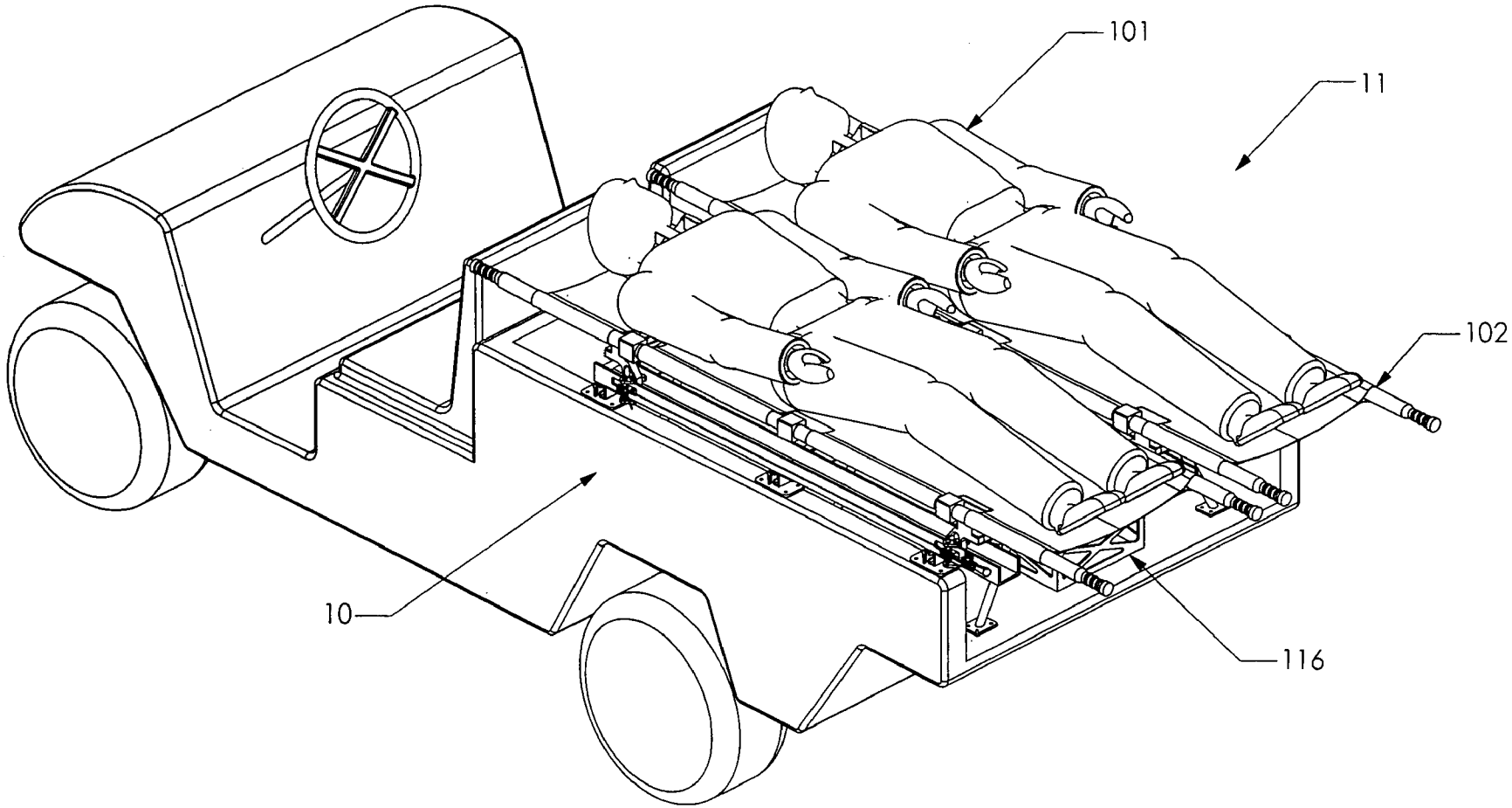
FIG. 2 is a perspective view of the (RMES) with both the left and the right support assemblies in the centered position, as it would be installed on a small off-road utility vehicle.
Figure 3:
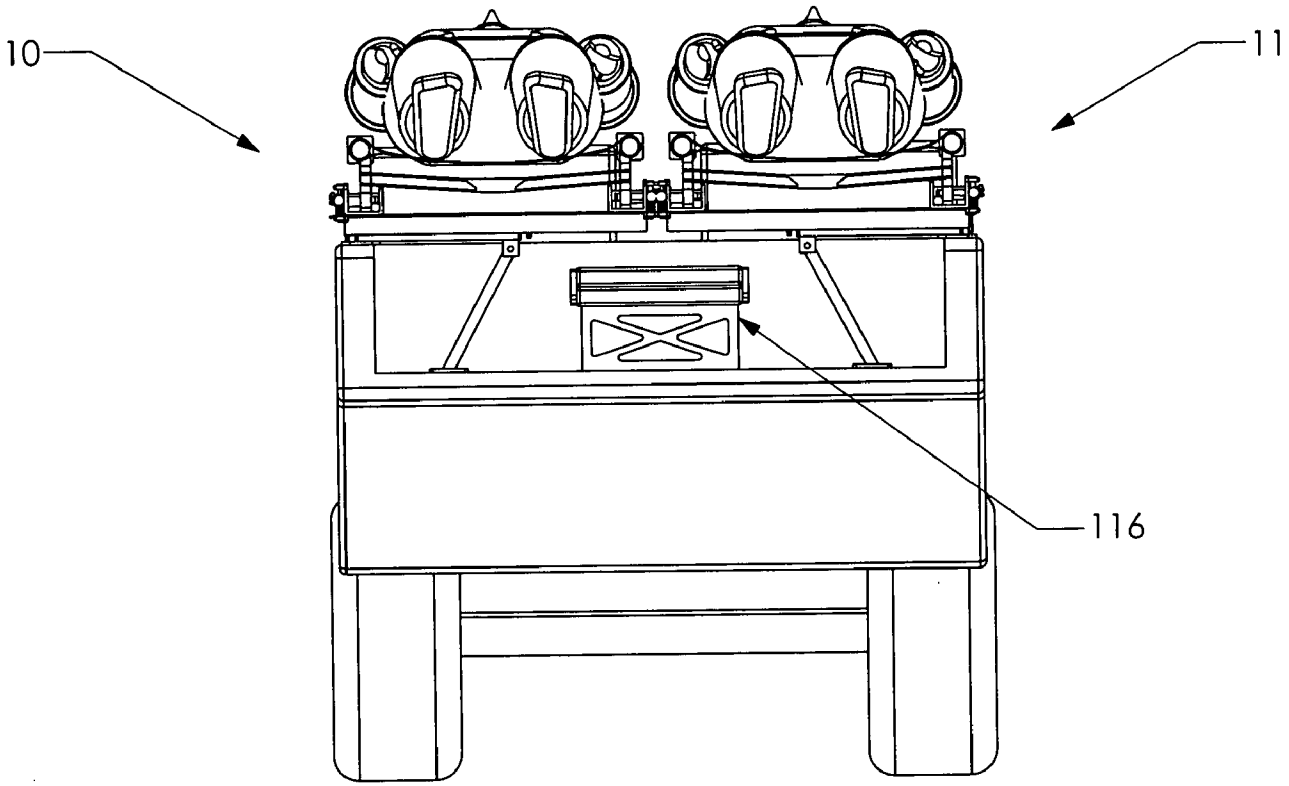
FIG. 3 is a rear view of the RMES with both the left and right support assemblies in the centered position, as it would be installed on a small off-road utility vehicle.
Figure 4:
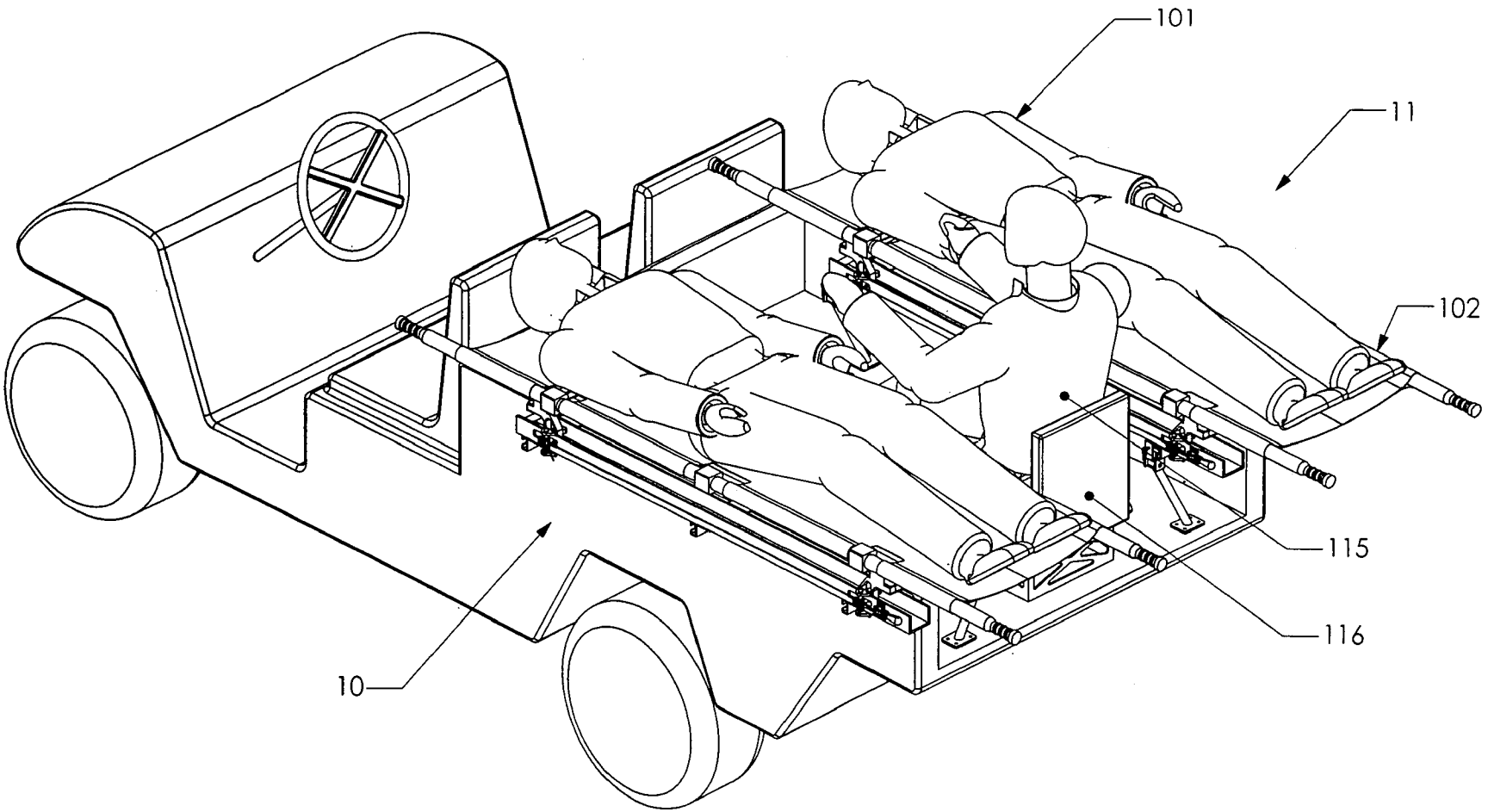
FIG. 4 is a perspective view of the RMES with both the left and right support assemblies in the extended position, as it would be installed on a small off-road utility vehicle.
Figure 5:
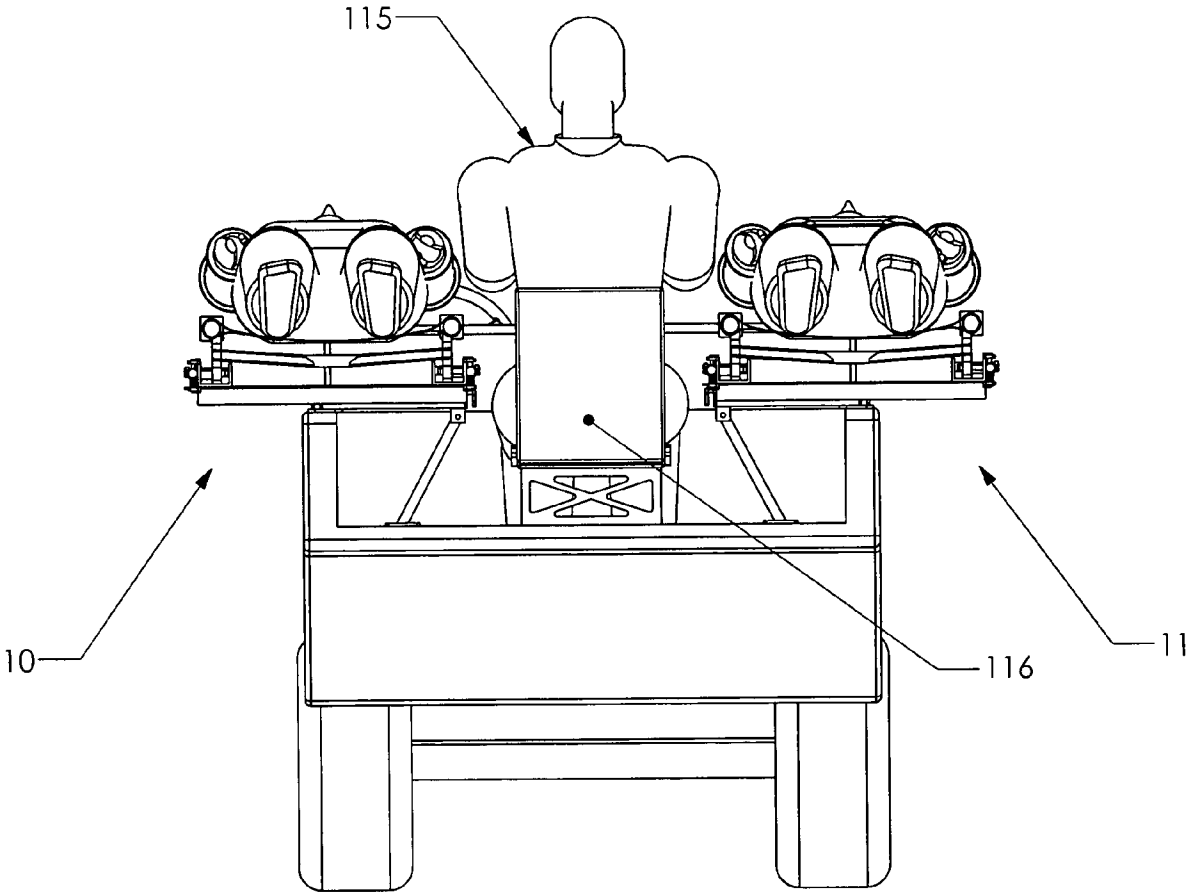
FIG. 5 is a rear view of the RMES with both the left and right support assemblies in the extended position, as it would be installed on a small off-road utility vehicle.

The first configuration offered by the system is achieved by locking both left and right support assemblies 10, 11 in centered positions, and collapsing the attendant seat 116. FIGS. 2 and 3 depict the system mounted to a utility vehicle, with both support assemblies in the centered position. The primary benefit of this configuration is that the vehicle maintains close to normal maneuverability. Maximum possible maneuverability is retained firstly because the patients are located entirely within the standard overall width of the vehicle. This allows the driver to negotiate narrow passages, congested city streets, etc., without having to worry about an onboard patient colliding with fixed obstacles that otherwise would be missed by the vehicle's standard body/chassis. Additionally, changes to the loaded vehicle's moment of inertia about its roll axis are minimized by locating the patients as close as possible to the vehicle's longitudinal centerline. A further benefit of this configuration is that while in storage, vehicles equipped with the RMES system do not occupy any more volume than their unequipped counterparts A second possible configuration is created by locating both left and right support assemblies 10, 11 in extended positions, and raising the attendant seat 116. FIGS. 1, 4 and 5 depict the RMES system mounted to a utility vehicle, with both left and right support assemblies 10 and 11 in the laterally extended position. The purpose of this configuration is to allow sufficient space between the patients 101 for a medical attendant 115. The laterally extended configuration illustrated in FIGS. 1, 4 and 5 is particularly desirable in that it provides the attendant 115 sufficient access to the patients' bodies to perform common emergency medical procedures. Such procedures may include endotracheal intubation, CPR, wound compression, attachment of physiological monitors, as well as other life saving treatments. Given the attendant's position along side each of the patients 101, the attendant 115 is able to perform the abovementioned procedures similarly to how he/she normally would in a standard size ambulance. The quality of medical care provided is optimized because the attendant is familiar with working in this position. This central location is additionally beneficial if the attendant is wearing a chemical or biological protective suit. Medical personnel wearing these bulky suits generally require more space to work than their normally clothed counterparts. With both support assemblies 10 and 11 in the laterally extended position, the RMES provides an emergency worker wearing a bulky protective suit more room to work than would normally be available aboard a small vehicle. Though vehicle maneuverability is slightly compromised, this configuration of the evacuation system allows patients to receive higher quality medical care than would normally be possible aboard such narrow vehicles. If physical dimensions and Gross Vehicle Weight Rating permit, this configuration also allows for the transport of an additional emergency worker or ambulatory patient in the front passenger seat.

Additional configurations may be created by locating only one of the two support assemblies in the extended or centered postion. These configurations may be useful in a variety of scenarios where it is desirable or necessary to compromise between vehicle maneuverability and onboard space. The benefits of the invention stem from the design and function of the left and right support assemblies 10,11. The support assemblies 10 and 11 are composed of identical parts, and, when installed, are mirror images of each other.

Turning now to FIGS. 6–9, the structure of a left support assembly 10 is illustrated in perspective view showing a patient and a stretcher supported by the support assembly 10. The support assembly 10 is installed in the cargo bed of a vehicle by rigidly attaching the support strut mounts 108 (FIGS. 6 and 7) and upper mounts 111 (FIG. 7) to the floor and side of the cargo bed respectively. The mounts 108 and 111 can be bolted to the vehicle, but may also be affixed to a vehicle using quick-release mechanisms such as spring-loaded clips or latches or other types of releasable attachment devices such as magnets, clamps or suction cups. Accordingly, the support assemblies can be installed for either temporary or permanent use. The support struts 109 can be manufactured in fixed lengths in order to suit specific vehicle geometries, or may be adjustable in length so that the system could be easily transferred between various types of vehicles. Length adjustment of support struts 109 can be accomplished through the use of telescoping tubes with snap button detents, though other methods such as threaded coaxial rod/tubing may also be used.

Once the mounts 108 and 111 and support struts 109 are afffixed to the vehicle, the support assemblies 10 and/or 11 may be adjusted and locked in either the centered (FIG. 2) or extended (FIG. 4) positions. The capability for lateral adjustment is facilitated by the three slide rails 106 slidably attached to the three base rails 112. The base rails 112 are rigidly supported by the upper mounts 111 and the support struts 109, while the slide rails 106 are free to translate laterally. In the preferred embodiment of this invention, the length of each of the three parallel slide rails 106 is approximately equal to the the width of the stretcher 102, and the length of each of the three parallel base rails 112 is approximately equal to half the width of the stretcher 102. This ratio of approximately 2:1 between the length of the slide rails and the length of the base rails ensures that when the slide rails are in the extended position, there is sufficient space in the center of the cargo bed for the attendant to sit.

The slide rails 106 are slidably attached to the three parallel base rails 112 by means of a rolling mechanism that only permits relative motion of the slide rails 106 in a direction that is transverse (i.e., orthogonal) to the length of the vehicle. Though the RMES illustrated herein employs rolling mechanism components described in U.S. Pat. No. 6,116,673, any low friction, single degree of freedom sliding or rolling mechanism can be used at the base rail/slide rail interface. When the slide rails have been adjusted to either the centered position (FIG. 2) or extended postion (FIG. 4) they are locked in position using the slide rail position locks 113. In order to prevent undesired motion while patients are being transported, the three slide rail position locks 113 must be manually engaged by an attendant.

Figure 9:
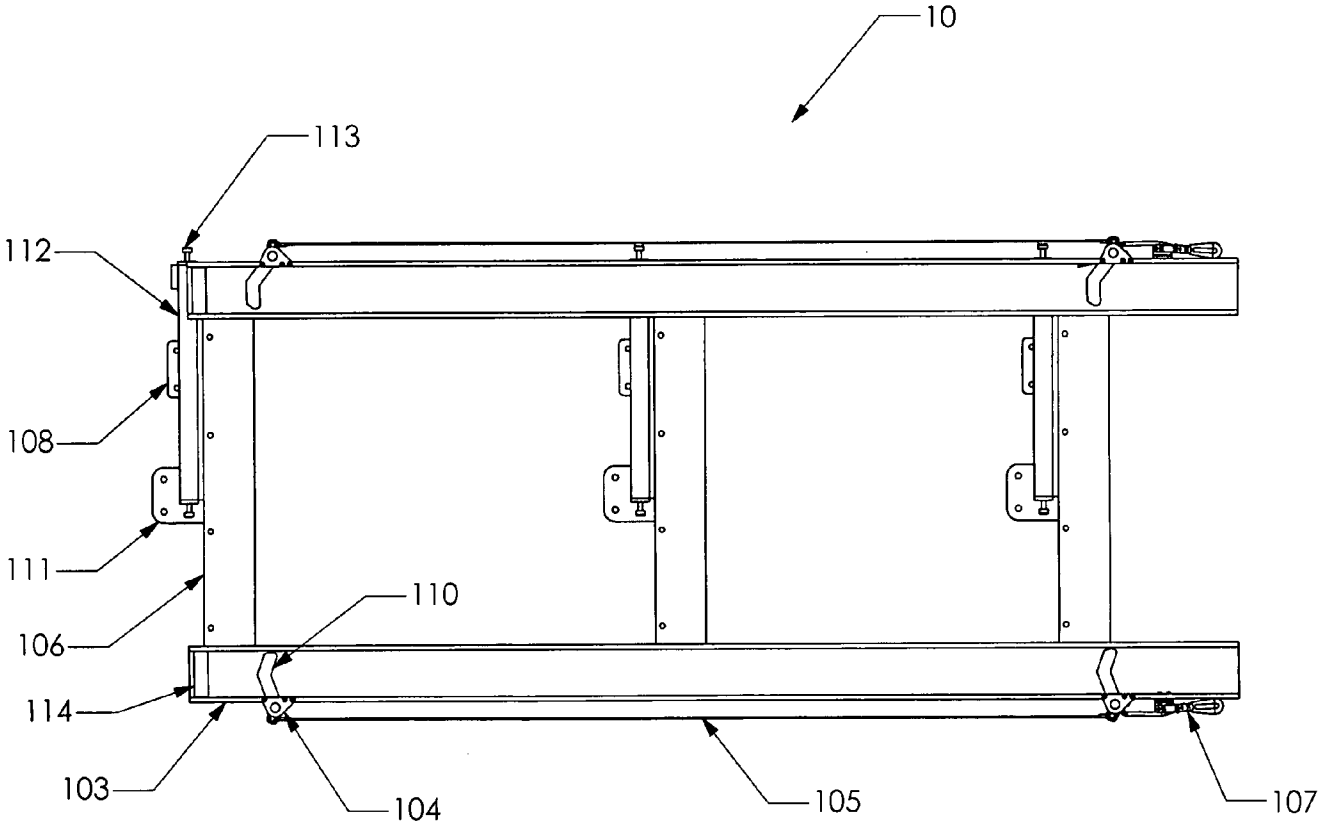
FIG. 9 is a top view of a left support assembly that has been configured in the extended position.
Figure 10:
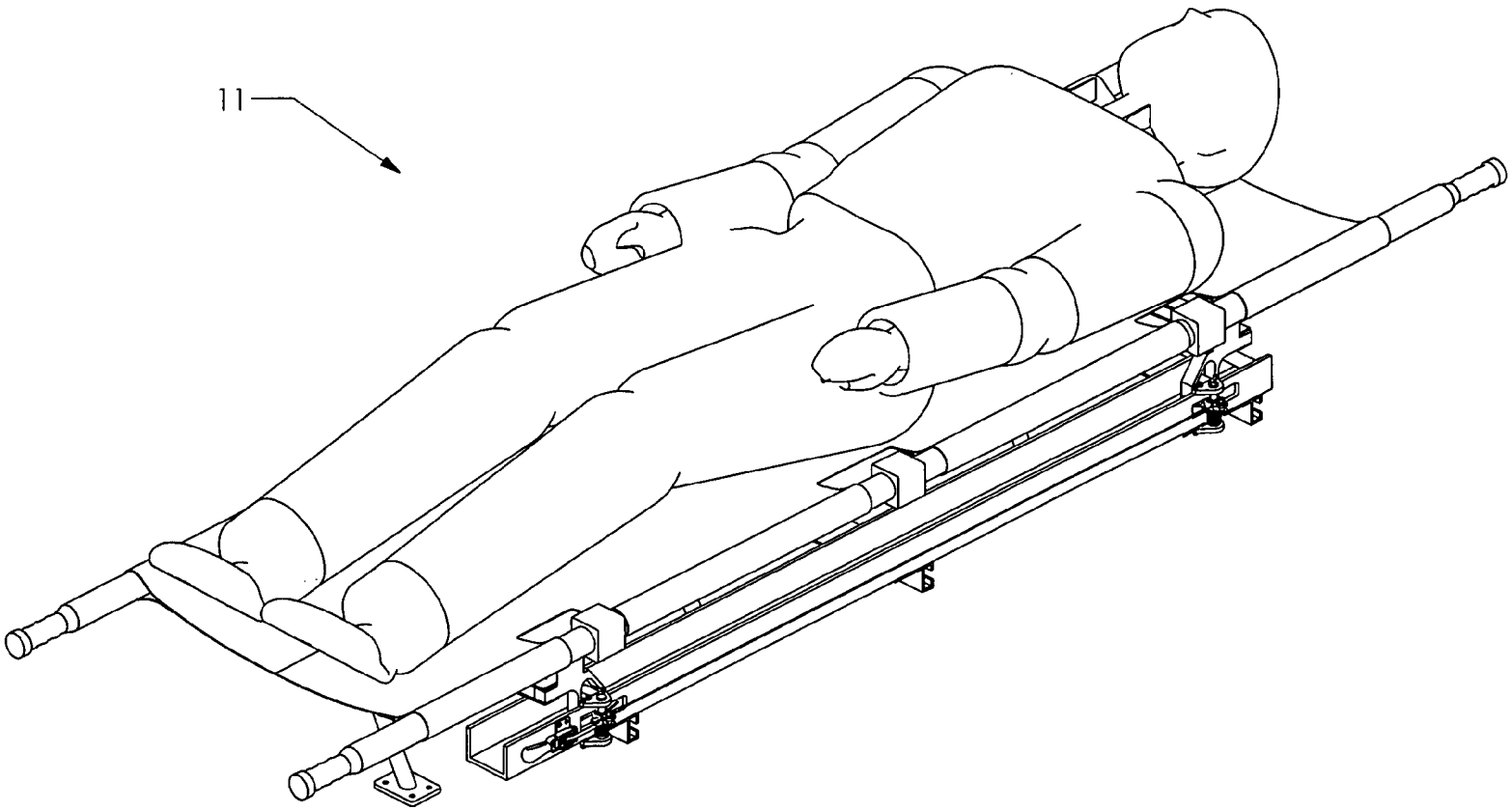
FIG. 10 is a perspective view of a patient on a stretcher loaded onto a right support assembly that has been configured in the extended position.

As illustrated in FIG. 9 of the drawings, the two parallel guide channels 103 on the left support assembly 10 are rigid, elongate members having a "C" or "U" shaped cross-section rigidly mounted to opposing ends of the three slide rails 106. Accordingly, the positions of the two parallel guide channels 103 relative to the centerline of the vehicle are defined by the lateral positions of the slide rails 106 with respect to the base rails 112. The spacing between the two parallel guide channels 103 on the support assembly 10 is approximately equal to the width of the stretcher 102.

Once the adjustable slide rails 106 of the support assembly 10 or 111 has been fixed in the desired position (i.e., centered or extended), a patient 101 supported on a stretcher 102 may be loaded onto the support assembly. The stretcher 102 is loaded from the rear of the vehicle by placing the front legs 81 (FIG. 8) of the stretcher into the guide channels 103 and sliding the stretcher forward. The stretcher is advanced until its front legs 81 make contact with the stops 114. As the legs 81 of the stretcher reach this position, they are automatically engaged by the lock levers 110. The lock levers are pivotally mounted on the guide channels and are actuated by the spring mechanisms 104. The spring mechanisms 104 apply a continual force that keeps their respective lock levers in the locked position unless they are manually disengaged. The lock levers engage the legs of the stretcher by rotating out of the way as the leading edge of the leg passes, and then rotating back into open center portion of the leg. Once positioned in the centers of the stretcher legs, the lock levers restrain the stretcher from motion in the upward and rearward directions. Forward and lateral motion of the stretcher is prevented by the stops 114 and the sides of the guide channels respectively.

When a patient and stretcher must be unloaded from the support assembly, the lock release clamps 107 are used to disengage the lock levers 110. A single lock release clamp 107 is used at the rearward end of each guide channel to simultaneously disengage both lock levers on the respective guide channels of a support assembly. This simultaneous operation is facilitated by the lock release cable 105 that connects the forward and rearward lock levers on each guide channel. Once all four locks 110 have been disengaged, the stretcher bearing the patient is slid rearward until the stretcher legs are completely free from the guide channels.

While particular embodiments of the present invention have been illustrated and described, it would be obvious to those skilled in the art that various other changes and modifications can be made without departing from the spirit and scope of the invention. For example, the support assemblies 10 and/or 11 may be adapted for installation in a boat for evacuating nonambulatory patients from a flooded area that is inaccessible to land vehicles. It is therefore intended to cover in the appended claims all such changes and modifications that are within the scope of this invention.

We claim:

1. A support assembly adapted to be installed in a vehicle having an open flat bed bounded laterally by left and right sides extending upwardly from the flat bed, the bed being open at the rear thereof, said support assembly being operable for receiving a stretcher bearing a patient, said stretcher having legs at forward and rearward ends thereof, said support assembly comprising:

(a) a plurality of base rails comprising rigid elongate members having a medial end and a lateral end;

(b) an upper mount affixed to said lateral end of said base rail, said upper mount being operable for affixing said lateral end of said base rail to the uppermost portion of a side of the flat bed of the vehicle;

(c) a support strut having an upper end and a lower end, said upper end being pivotally mounted to said medial end of said base plate;

(d) a support strut mounting plate pivotally attached to said lower end of said support strut, said support strut mounting plate being operable for attaching said lower end of said support strut to said flat bed of said vehicle;

(e) a plurality of rigid elongate slide rails, each said slide rail being slidably attached to one of said base rails such that said slide rail is be movable in a direction parallel to said base rail, each slide rail having a medial end and a lateral end;

(f) slide rail locking means affixed to said base rail operable for locking said slide rail in a predetermined position with respect to said base rail;

(g) first and second guide rails comprising rigid elongate members having a "C-shaped" cross section, said first guide rail being affixed to said medial end of said slide rails and said second guide rail being affixed to said lateral ends of said slide rails, said guide rails having a groove in an upper surface thereof operable for slidably receiving said legs of said stretcher; and (h) stretcher locking means disposed on said guide rails operable for locking said legs of said stretcher in locking engagement with said guide rails;

(i) at least one lock release means operable for unlocking said stretcher locking means to disengage said stretcher from said guide rail.

2. A rapid medical evacuation system comprising first and second support assemblies in accordance with claim 1 wherein said second support assembly is a mirror image of said first support assembly such that when both support assemblies are mounted within a flat bed of a vehicle and extended laterally with respect to a midline of said flat bed, a space is created between said first and second support assemblies sufficient to permit the disposition of a medical attendant within said space.

3. A support assembly of claim 1 adapted to be installed in a vehicle having an open flat bed bounded laterally by left and right sides extending upwardly from the flat bed, the flat bed being open at the rear thereof, said support assembly having two parallel guide rails thereon operable for receiving a stretcher bearing a patient, said support assembly having extension means thereon operable for moving said two guide rails in a lateral direction with respect to a midline of said open flat bed.

4. The support assembly of claim 3 comprising lateral extension locking means operable for locking said guide rails in one of a plurality of desired positions with respect to a midline of said flat bed.

* * * * *